US005582953A

United States Patent [19]

Uyttendaele et al.

[11] Patent Number: 5,582,953

[45] Date of Patent: Dec. 10, 1996

[54] DIRECT THERMAL RECORDING PROCESS

[75] Inventors: Carlo Uyttendaele, Mortsel; Herman Uytterhoeven, Bonheiden; Bartholomeus Horsten, Rumst, all of Belgium

[73] Assignee: Agfa-Gevaert N.V., Mortsel, Belgium

[21] Appl. No.: 450,631

[22] Filed: May 25, 1995

[30] Foreign Application Priority Data

Jul. 7, 1994 [EP] European Pat. Off. ..... 94201954

[51] Int. Cl.[6] ..... G03C 8/110

[52] U.S. Cl. ..... 430/203; 430/348; 430/600; 430/617; 430/961; 430/965

[58] Field of Search ..... 430/617, 203, 430/3, 600, 965, 349; 428/913, 961

[56] References Cited

U.S. PATENT DOCUMENTS 3,751,249 8/1973 Hiller ..... 430/617

5,424,182 6/1995 Marginean, Sr. et al. ..... 430/617

*Primary Examiner*—Thorl Chea

*Attorney, Agent, or Firm*—Brumbaugh, Graves, Donohue & Raymond

[57] ABSTRACT

A direct thermal recording process wherein a direct thermal recording material is heated dot-wise and said direct thermal recording material comprises on a substrate an imaging layer containing uniformly distributed in a film-forming polymeric binder (i) one or more substantially light-insensitive organic silver salts being no double salts, said silver salt(s) being in thermal working relationship with (ii) an organic reducing agent therefor, characterized in that said reducing agent is a benzene compound the benzene nucleus of which is substituted by no more than two hydroxy groups which are present in 3,4-position on said nucleus and have in the 1-position of said nucleus a substituent linked to said nucleus by means of a carbonyl group.

9 Claims, No Drawings

DIRECT THERMAL RECORDING PROCESS

FIELD OF THE INVENTION

The present invention relates to a direct thermal imaging process with improved neutral tone reproduction.

BACKGROUND OF THE INVENTION

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.

2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions or incorporated dyes are transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1Thermography". Thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–499 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place.

In a special embodiment of direct thermal imaging a heat-sensitive recording material is used in the form of an electrically resistive ribbon having a multilayered structure in which a carbon-loaded polycarbonate is coated with a thin aluminium film (ref. Progress in Basic Principles of Imaging Systems—Proceedings of the International Congress of Photographic Science Köln (Cologne), 1986 ed. by Friedrich Granzer and Erik Moisar—Friedr. Vieweg & Sohn—Braunschweig/Wiesbaden, FIG. 6. p. 622). Current is injected into the resistive ribbon by electrically addressing a printhead electrode contacting the carbon-loaded substrate, thus resulting in highly localized heating of the ribbon beneath the energized electrode.

The fact that in using a resistive ribbon recording material heat is generated directly in the resistive ribbon and only the travelling ribbon gets hot (not the printheads) an inherent advantage in printing speed is obtained. In applying the thermal printhead technology the various elements of the thermal printhead get hot and must cool down before the printhead can print without cross-talk in a next position.

In another embodiment of direct thermal imaging the recording material is image-wise or pattern-wise heated by means of a modulated laser beam. For example, image-wise modulated infra-red laser light is absorbed in the recording layer in infra-red light absorbing substances converting infra-red radiation into the necessary heat for the imaging reaction.

The imagewise applied laser light has not necessarily to be infrared light since the power of a laser in the visible light range and even in the ultraviolet region can be thus high that sufficient heat is generated on absorption of the laser light in the recording material. There is no limitation on the kind of laser used which may be a gas laser, gas ion laser, e.g. argon ion laser, solid state laser, e.g. Nd:YAG laser, dye laser or semi-conductor laser.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

A wide variety of chemical systems has been suggested for use in thermography as described e.g. on page 138 of the above mentioned book of Kurt I. Jacobson et al.

Thermal recording materials are known for the production of black-and-white images as well as for the production of color images.

According to published European patent application 0 599 580 Al a thermal recording sheet suited for thermographic formation of organic dyes contains a leuco dye type chromogenic component consisting of a leuco dye, an organic color developer and a metal chelate type chromogenic component consisting of an electron acceptor and an electron donor, wherein the electron acceptor is a metal double salt of a fatty acid having 16 to 35 carbon atoms, and the electron donor is a polyhydric hydroxy aromatic compound, e.g. a 3,4-dihydroxy benzoic acid amide [see compound(2)].

Particularly useful for black-and-white image formation are thermographic materials the image forming layers of which contain a substantially light-insensitive organic silver salt that at elevated temperature is reduced to silver by a selected organic reducing agent such as hydroquinone, substituted hydroquinones, hindered phenols, pyrogallol, methyl gallate, leuco dyes and the like (ref. U.S. Pat. No. 5,275,932).

Preferred reducing agents for use in combination with said silver salt yield silver images of high optical density, and maintain there reducing property on storage without giving rise to substantial fog.

For high quality image reproduction further preference is given to reducing agents having the above properties in association with the capability to provide silver images with as good as possible colour neutrality having a more pleasing appearance and contrast.

The obtaining of good colour neutrality is particularly problematic when using in thermal recording a thermal print head of which the heat supplied by each micro-resistor is very intensive during a very short heating time so that locally relatively high temperatures are reached that have a "browning" influence on the colour of the silver formed in the reduction process.

OBJECTS AND SUMMARY OF THE INVENTION

It is an object of the present invention to provide a direct thermal imaging process yielding images the colour-neutrality of which is particularly good at maximum density higher than 2.5.

Other objects and advantages of the present invention will appear from the further description.

In accordance with the present invention a direct thermal recording process is provided wherein a direct thermal recording material is heated dot-wise and said direct thermal recording material comprises on a substrate an imaging layer containing uniformly distributed in a film-forming polymeric binder (i) one or more substantially light-insensitive organic silver salts being no double salts, said silver salt(s) being in thermal working relationship with (ii) an organic reducing agent therefor, characterized in that said reducing agent is a benzene compound the benzene nucleus of which is substituted by no more than two hydroxy groups which are present in 3,4-position on said nucleus and have in the 1-position of said nucleus a substituent linked to said nucleus by means of a carbonyl group.

By "thermal working relationship" is meant here that said substantially light-insensitive silver salt and said organic reducing agent can react by means of heat, i.e. at elevated temperature, to form metallic silver. For that purpose said ingredients (i) and (ii) may be present in the same binder-containing layer or in different layers wherefrom by heat they can come into reactive contact with each other, e.g. by diffusion in molten state.

DETAILED DESCRIPTION OF THE INVENTION

Preferred "carbonyl" substituted 3,4-dihydroxy-benzene reducing agents for use according to the present invention are less volatile than catechol and are selected from the group consisting of 3,4-dihydroxy-benzoic acid, an alkyl or aryl ester thereof, 3,4-dihydroxy-benzaldehyde, 3,4-dihydroxy-benzamide and aryl or alkyl (3,4-dihydroxyphenyl) ketones. The alkyl esters of 3,4-dihydroxy-benzoic acid comprise e.g. from 1 to 18 carbon atoms, but are preferably $C_{1-C4}$ alkyl esters.

Substantially light-insensitive organic silver salts particularly suited for use in a direct thermal recording process according to the present invention are silver salts (no double salts) of aliphatic carboxylic acids known as fatty acids, wherein the aliphatic carbon chain has preferably at least 12 C-atoms, e.g. silver laurate, silver palmirate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

The silver image density depends on the coverage of said substantially light-insensitive silver salts in combination with the above mentioned reducing agent(s) and has to be preferably such that, on heating above 100° C., an optical density of at least 2.5 can be obtained.

The thickness of the imaging layer is preferably in the range of 5 to 50 μm.

According to a special embodiment said substantially light-insensitive organic silver salt and said organic reducing agent(s) are present in different layers wherefrom by heat they can come into reactive contact with each other.

The film-forming polymeric binder of the imaging layer of the direct thermal recording material used according to the present invention is preferably a water-insoluble thermoplastic resin or mixture of such resins, wherein the silver salt can be dispersed homogeneously. For that purpose all kinds of natural, modified natural or synthetic water-insoluble resins may be used, e.g. cellulose derivatives such as ethylcellulose, cellulose esters, e.g. cellulose nitrate, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters and polyethylene or mixtures thereof.

A particularly suitable polyvinyl butyral containing a minor amount of vinyl alcohol units is marketed under the tradename BUTVAR B79 of Monsanto USA and provides a good adherence to paper and properly subbed polyester supports.

The layer containing the organic silver salt is commonly coated from an organic solvent containing the binder in dissolved form.

The continuous tone reproduction capability of a heat-sensitive imaging material used according to the present invention is favoured by a relatively high binder to silver salt weight ratio in the imaging layer. Preferably said ratio is in the range of 1/2 to 6/1, and more preferably from 1/1 to 4/1.

The binder of the imaging layer may be combined with waxes or "heat solvents" also called "thermal solvents" or "thermosolvents" improving the reaction speed of the redox-reaction at elevated temperature.

By the term "heat solvent" in this invention is meant a nonhydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydrothiophene-1,1-dioxide, methyl anisate and 1,10-decanediol being described as heat solvents in Research Disclosure, December 1976, (item 15027) pages 26–28. Still other examples of heat solvents have been described in U.S. Pat. No. 3,438,776, and 4,740,446, and in published EP-A 0 119 615 and 0 122 512 and DE-A 3 339 810.

In order to further correct for deficiencies in neutrality of image tone, i.e. to come still closer to perfect black in the higher densities and neutral grey in the lower densities the recording layer contains in admixture with said organic silver salt and reducing agents a so-called toning agent known from thermography or photo-thermography operating with reducible silver salts.

Suitable toning agents are phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are succinimides and the heterocyclic toner compounds of the benzoxazine dione or naphthoxazine dione type within the scope of following general formula:

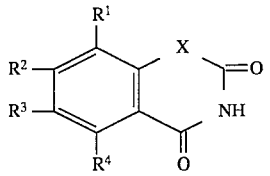

in which:

X represents 0 or N-alkyl;

each of $R^1$, $R^2$, $R^3$ and $R^4$ (same or different) represents hydrogen, alkyl, e.g. $C_{1-C20}$ alkyl, preferably $C_{1-C4}$ alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine: or $R^1$ and $R^2$ or $R^2$ and $R^3$ represent the ring members required to complete a fused aromatic ring, preferably a benzene ring, or $R^3$ and $R^4$ represent the ring members required to complete a fused aromatic or cyclohexane ring. Toners within the scope of said general formula are described in GB-P 1,439,478 and U.S. Pat. No. 3,951,660.

A toner compound particularly suited for use in combination with the above mentioned 3,4-dihydroxy benzene reducing agents is 3,4-dihydro-2,4-dioxo-1,3,2H-benzoxazine described in U.S. Pat. No. 3,951,660.

In addition to said ingredients the imaging layer may contain other additives such as free fatty acids, antistatic agents, e.g. non-ionic antistatic agents including a fluorocarbon group as e.g. in $F_3C(CF_2)_6CONH(CH_2CH_2O)$—H, ultraviolet light absorbing compounds, white light reflecting and/or ultraviolet radiation reflecting pigments, and/or optical brightening agents.

The substrate also called support for the heat-sensitive imaging layer of the thermosensitive recording material used according to the present invention is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if need be to improve the adherence to the thereon coated heat-sensitive imaging layer.

The coating of the imaging layer may proceed by any coating technique e.g. as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Direct thermal imaging can be used for both the production of transparencies and reflection type prints. Such means that the support may be transparent or opaque, e.g. the support has a white light reflecting aspect. For example, a paper base is used which may contain white light reflecting pigments, optionally also applied in an interlayer between the recording layer and said base. In case a transparent base is used, said base may be colourless or coloured, e.g. has a blue colour.

In the hard copy field recording materials on white opaque base are used, whereas in the medical diagnostic field black-imaged transparencies find wide application in inspection techniques operating with a light box.

The recording materials containing the hereinbefore mentioned "carbonyl" substituted 3,4-dihydroxybenzene reducing agent(s) are particularly suited for use in thermographic recording techniques operating with thermal print-heads. Suitable thermal printing heads are e.g. a Fujitsu Thermal Head (FTP-040 MCS001), a TDK Thermal Head F415 HH7-1089, and a Rohm Thermal Head KE 2008-F3.

In a special embodiment in order to avoid direct contact of the printheads with the outermost layer of said recording material, the imagewise heating of the recording material with said printheads proceeds through a contacting but removable thin resin sheet or web wherefrom during said heating no transfer of imaging material can take place.

In an other embodiment in order to improve resistance against abrasion, which may occur by frictional contact with the printheads, the imaging layer is coated with a protective coating and/or contains substances having anti-sticking properties e.g. (a) lubricating agent(s). Thus, the outermost layer of the heat-sensitive recording material may comprise a dissolved lubricating material and/or a dispersed particulate lubricating material, e.g. talc particles, optionally protruding from the outermost layer. Examples of suitable lubricating materials are a surface active agent, a liquid lubricant, a solid lubricant or mixtures thereof.

The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters and fluoroalkyl $C_{2-C20}$ aliphatic acids. Examples of liquid lubricants include silicone oils, synthetic oils, saturated hydrocarbons and glycols. Examples of solid organic lubricants include various higher alcohols such as stearyl alcohol, fatty acids and fatty acid esters.

As examples of outermost layers acting as so-called slipping layers are mentioned layers made from a styrene-acrylonitrile copolymer or a styrene-acrylonitrile-butadiene copolymer or binder mixture hereof containing as lubricant in an amount of 0.1 to 10% by weight with respect to said binder(s) a polysiloxane-polyether copolymer or polytetrafluoroethylene or a mixture hereof.

Another suitable outermost slipping layer may be obtained by coating a solution of at least one silicon compound and a substance capable of forming during the coating procedure a polymer having an inorganic backbone which is an oxide of a group IVa or IVb element as described in published European patent application 0554576.

Other suitable protective layer compositions that may be applied as slipping (anti-stick) coating are described e.g. in published European patent applications (EP-A) 0 501 072 and 0 492 411.

The following examples illustrate the present invention. The percentages, parts and ratios are by weight unless otherwise indicated.

EXAMPLES 1 to 9

(comparative examples)

Thermosensitive recording materials A-I

A subbed polyethylene terephthalate support having a thickness of 100 μm was doctor blade-coated from a coating composition containing methyl ethyl ketone as a solvent and the following ingredients so as to obtain thereon after drying for 1 h at 50° C. an imaging layer containing:

| | |
|---|---|
| silver behenate | 5.13 g/m$^2$ |
| polyvinyl butyral (BUTVAR B79-tradename) | 5.13 g/m$^2$ |
| 3,4-dihydro-2,4-dioxo-1,3,2H-benzoxazine | 0.39 g/m$^2$ |
| BAYSILON Öl (tradename of Bayer AG - Germany) | 12 mg/m$^2$ |

reducing agent A to I as in Table 1 applied in chemical equivalent weight (g/m$^{2)}$ coverage

TABLE 1

| Material | Reducing agent | Coverage g/m$^2$ |
|---|---|---|
| A | Indane I | 0.98 |
| B | 3,4-Dihydroxybenzoic acid | 0.88 |
| C | Ethyl ester of 3,4-dihydroxybenzoic acid | 1.03 |
| D | n-Butyl ester of 3,4-dihydroxybenzoic acid | 1.21 |
| E | 3,4-Dihydroxybenzaldehyde | 0.80 |
| F | Phenyl (3,4-dihydroxyphenyl) ketone | 1.22 |
| G | Ethyl gallate | 1.14 |
| H | Hydroquinone | 0.63 |
| I | 2,3-Dihydroxybenzoic acid | 0.88 |

Indane I is 3,3,3,3'-tetramethyl-5,6,5',6'-tetrahydroxyspirobisindane known as reducing agent for photo-exposed silver halide from U.S. Pat. No. 3,440,049. It is prepared by condensation of catechol with acetone as described by Baker, J. Chem. Soc., 1943, pp. 1678–81.

The materials B, C, D, E and F are invention materials, the other ones are comparative test materials.

Printing

The above defined thermosensitive recording materials A to I are used in a thermal head printer.

The printer was equipped with a thin film thermal head with a resolution of 300 dpi and was operated with a line time of 18 msec (the line time being the time needed for printing one line). During said line time the print head received constant power. The average printing power, being the total amount of electrical input energy during one line time divided by the line time and by the surface area of the heat-generating resistors was 9.8 W/mm$^2$ being sufficient to obtain maximum optical density in each of said recording materials.

During printing the print head was separated from the imaging layer by a thin intermediate material and made contact with the slipping layer of a separatable intermediate 5 μm thick polyethylene terephthalate ribbon being coated in consecutive order with a subbing layer, heat-resistant layer and said slipping layer (antifriction layer) giving the ribbon a total thickness of 6 μm.

Said subbing layer, also called primer layer, is a layer of a copolyester being a polycondensation product of ethylene glycol, adipic acid, neopentyl glycol, terephthalic acid, isophthalic acid and glycerol. On this subbing layer, a heat-resistant layer has been coated from methyl ethyl ketone containing a polycarbonate having the following structure and being applied at a coverage of 0.5 g/m$^2$ :

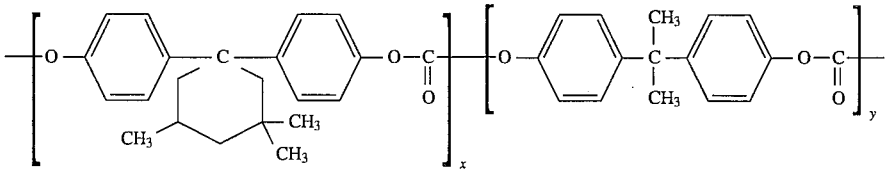

wherein x=55 mol % and y=45 mol %.

On top of said polycarbonate layer an outermost slipping layer of polyether modified polydimethylsiloxane (TEGOGLIDE 410, tradename of T. H. Goldschmidt) has been applied at 0.07 g/m$^2$ from isopropanol.

Evaluation

For evaluating the colour neutrality the optical density (D) of the obtained images is measured with blue, green and red filter using a densitometer MacBeth TD904 (tradename). As a result thereof in order of increasing magnitude optical density values $D_1$, $D_2$ and $D_3$ were obtained. Using these values in the following equation a numerical colour value (NCV) was obtained:

$$NCV = \frac{D_1 \times D_2}{(D_3)^2}$$

The larger the NCV value the better the colour neutrality of the obtained image. Maximal colour neutrality corresponds with a NCV value of 1.

The NCV values obtained with the recording materials A to I together with their optical density behind ortho filter (green light transmitting filter) $D_{ortho}$ are listed in the following Table 2.

TABLE 2

| Material | NCV | $D_{ortho}$ |
|---|---|---|
| A | 0.16 | 3.4 |
| B | 0.68 | 3.7 |
| C | 0.57 | 3.4 |
| D | 0.62 | 3.5 |
| E | 0.72 | 3.4 |
| F | 0.63 | 3.9 |
| G | 0.39 | 4.1 |
| H | 0.12 | 2.6 |
| I | 0.33 | 3.6 |

As can be learned from said Table 2 the silver images obtained by heating the invention materials B, C, D, E and F by print head resistors have a better colour-neutrality than the images of the comparative (non-invention) materials A, G, H and I.

We claim:

1. A direct thermal recording process wherein a direct thermal recording material is heated dot-wise and said direct thermal recording material comprises on a substrate an imaging layer, the imaging layer containing uniformly distributed in a film-forming polymeric binder (i) one or more substantially light-insensitive organic silver salts being no double salts, said silver salt(s) being in thermal working relationship with (ii) an organic reducing agent therefor, wherein said reducing agent is a benzene compound the benzene nucleus of which is substituted with a substitutent linked to said benzene nucleus by means of a carbonyl group, wherein said carbonyl group is linked to said benzene nucleus at a position which is designated the 1-position of said benzene nucleus, wherein said benzene nucleus is further substituted in a 3-position relative to the 1-position with a single hydroxy group and in a 4-position relative to the 1-position with a single hydroxy group, wherein said reducing agent is selected from the group consisting of an alkyl or aryl ester of 3,4dihydroxybenzoic acid, 3,4-dihydroxy-benzaldehyde, 3,4-dihydroxy-benzamide and an alkyl or aryl (3,4-dihydroxyphenyl) ketone.

2. The recording process according to claim 1, wherein said reducing agent being considered as a primary or main reducing agent is present in conjunction with one or more auxiliary reducing agent(s).

3. The recording process according to claim 1, wherein said substantially light-insensitive organic silver salt is a silver salt of an aliphatic carboxylic acid (fatty acid) having at least 12 C-atoms.

4. The recording process according to claim 3, wherein said organic silver salt is silver palmirate, silver stearate or silver behenate or mixtures thereof.

5. The recording process according to claim 1, wherein the binder to silver salt weight ratio in the imaging layer is in the range of 1/2 to 6/1.

6. The recording process according to claim 1, wherein said binder is a polyvinylbutyral.

7. The recording process according to claim 1, wherein said substantially light-insensitive organic silver salt and said organic reducing agent are present in different layers wherefrom by heat they can come into reactive contact with each other by heat.

8. The recording process according to claim 1, wherein the imaging layer contains in admixture with said silver salt at least one toning agent being a phthalimide, phthalazinone, succinimide or heterocyclic compound corresponding to following general formula:

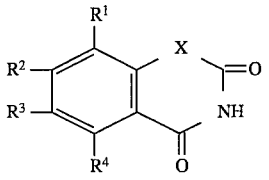

in which:

X represents 0 or N-alkyl;

each of $R^1$, $R^2$, $R_3$ and $R^4$ (same or different) represents hydrogen, alkyl, cycloalkyl, alkoxy, alkylthio, hydroxy, dialkylamino or halogen; or $R^1$ and $R^2$ or $R^2$ and $R^3$ together represent the ring members required to complete a fused aromatic ring, or $R^3$ and $R^4$ together represent the ring members required to complete a fused aromatic or cyclohexane ring.

9. The recording process according to claim 1, wherein said recording material is provided with an outermost protective layer acting as slipping layer.

* * * * *